US006034335A

United States Patent [19]

Aufderheide et al.

[11] Patent Number: 6,034,335

[45] Date of Patent: Mar. 7, 2000

[54] ANALOG TOUCH SCREEN WITH COATING FOR INHIBITING INCREASED CONTACT RESISTANCE

[75] Inventors: Brian E. Aufderheide, Cedarburg; Michael J. Robrecht, Whitefish Bay, both of Wis.

[73] Assignee: Dynapro Thin Films Products, Milwaukee, Wis.

[21] Appl. No.: 08/270,215

[22] Filed: Jul. 1, 1994

Related U.S. Application Data

[63] Continuation of application No. 07/984,057, Nov. 30, 1992, abandoned.

[51] Int. Cl.[7] ..... H01H 13/70; H01H 1/02

[52] U.S. Cl. ..... 200/5 A; 200/512; 200/268

[58] Field of Search ..... 200/5 R, 5 A, 200/262, 268, 512, 517

[56] References Cited

U.S. PATENT DOCUMENTS

| | | | |
|---|---|---|---|
| 3,778,576 | 12/1973 | Anderson et al. | 200/166 C |
| 4,123,631 | 10/1978 | Lewis | 200/52 R |
| 4,449,023 | 5/1984 | Hilhorst | 200/159 |
| 4,518,469 | 5/1985 | Ng et al. | 204/44.5 |
| 4,758,464 | 7/1988 | Masuzawa et al. | 428/220 |
| 4,786,767 | 11/1988 | Kuhlman | 200/5 A |
| 4,827,085 | 5/1989 | Yaniv et al. | 178/18 |
| 4,931,782 | 6/1990 | Jackson | 340/706 |
| 4,958,148 | 9/1990 | Olson | 340/712 |
| 5,066,550 | 11/1991 | Horibe et al. | 428/670 |
| 5,180,482 | 1/1993 | Abys et al. | 205/224 |
| 5,225,273 | 7/1993 | Mikoshiba et al. | 428/323 |

*Primary Examiner*—Michael Friedhofer
*Attorney, Agent, or Firm*—Foley & Lardner

[57] ABSTRACT

Analog resistance touch switches and matrix type touch switches have contacts coated with a very thin film, which in use does not form an appreciable amount of an insulating oxide, to inhibit changes in contact resistance and extend operating life.

17 Claims, 4 Drawing Sheets

ANALOG TOUCH SCREEN WITH COATING FOR INHIBITING INCREASED CONTACT RESISTANCE

This is a continuation of application Ser. No. 07/984,057 filed Nov. 30, 1992 abandoned.

BACKGROUND OF THE INVENTION

1. Field of the Invention

The field of the invention is electrical switches, and more particularly, transparent membraneous switches known as touch panel switches or touch screen switches.

2. Description of the Background Art

Transparent touch screens are used as input devices for computers, often being disposed over the screen of a monitor or CRT or other type of visual display. Two types of resistive touch screen switches are "analog resistive" and "matrix". In an analog resistive touch screen, the location of the touch is decoded by analyzing the screen as a voltage divider in the X-direction and in the Y-direction based on voltage readings in the X-direction and Y-direction, respectively, caused by a touch anywhere on the screen. In matrix switches, the contacts on one layer are conductive strips running in an X-direction and opposing contacts on a second layer are conductive strips running in a Y-direction, so that each switch location is defined by the intersection of an X-direction conductive strip and a Y-direction conductive strip.

Both analog resistive and matrix touch screens are electrical contact devices with resistance type contacts. Some of these devices utilize switch contacts and switch conductors formed of indium tin oxide (ITO) or tin oxide, which are semiconductive ceramic materials exhibiting transparency and light transmission qualities which are advantageous for application to touch screens.

When resistive touch screens are operated, contact is made between opposing surfaces of ITO or tin oxide. Electrical contact resistance has been observed to increase significantly after many cycles of operation (switch closures). This can cause problems with switch reliability.

When the switch contacts are closed, a very small amount of localized surface deterioration takes place. If the switch is closed many times in one location, this deterioration may cause an increase in contact resistance over time. If the contact resistance between the two conductive planes of thin film becomes large enough to no longer be considered insignificant, the decoding circuitry can no longer determine the position of the touch, which will eventually lead to switch malfunction.

There is a problem of increasing contact resistance over the life of resistive touch screens. The life of a touch screen is one of its more important characteristics. One commercial objective is that a touch screen should last as long as the display on which it is used. Improvement in maintaining contact resistance improves the important performance areas of product life and switch function consistency.

SUMMARY OF THE INVENTION

In the invention, a very thin film of a metal, which in use does not form an appreciable amount of insulating oxide, such as palladium, platinum, iridium, gold, silver, rhodium or a mixture thereof, is coated over at least one of a pair of opposing, spaced apart contacts formed of a transparent or semi-transparent conductive material. This relatively thin film probably forms islands rather than a continuous film.

Therefore, it does not affect the overall operating resistance of the contacts. Contact resistance is maintained within an acceptable operating range over many switch operating cycles.

The invention is more particularly embodied in a switch comprising a substrate; a flex member; a spacer between the flex member and the substrate; a first switch contact of at least semi-transparent, conductive material on the substrate; a second switch contact of at least semi-transparent, conductive material on the flex member positioned in opposing relation to the first contact and spaced apart from the first contact by a gap which is closed when the flex member is moved toward the substrate to bring the contacts in operational contact with each other; and a metallic film which does not form an appreciable amount of insulating oxide, the film being formed over at least one of the first and second switch contacts to reduce the effects of repeated switch operation on contact resistance over many operating cycles.

If a very thin film of palladium, in a thickness range from about 10 Å to about 30 Å, is coated over the surfaces of two contacts formed of indium tin oxide (ITO), contact life is increased from approximately 40,000 cycles to over 2 million cycles and yet there is only a very small change in optical properties. The palladium layer is so thin that its sheet resistance does not appreciably alter the sheet resistance of the ITO contacts in the X-Y plane. This is important to the operation of an analog resistive touch screen. The effect is thought to result from the palladium forming islands rather than a continuous film over the switch contacts. A continuous film would provide an additional resistive element and possibly a significant variation in sheet resistance.

In most applications, the base transparent conductor would be indium tin oxide (ITO) although tin oxide could also be used. Metallic films of neutral color may be used as the coating. Metals such as platinum, iridium or rhodium may work as well as palladium in preventing changes of contact resistance. A thin layer of gold may be used where amber coloration is desired. Silver may also be used, or a mixture, including an alloy of one or more of the foregoing metals, may be used.

One type of display that this type of touch screen might be used with, uses a neutral density filter. The gray color of the palladium provides a secondary attribute that is advantageous for this product.

Other objects and advantages, besides those discussed above, shall be apparent to those of ordinary skill in the art from the description of the preferred embodiment which follows. In the description, reference is made to the accompanying drawings, which form a part hereof, and which illustrate examples of the invention. Such examples, however, are not exhaustive of the various embodiments of the invention, and therefore reference is made to the claims which follow the description for determining the scope of the invention.

DETAILED DESCRIPTION OF THE PREFERRED EMBODIMENTS

Figure 1:
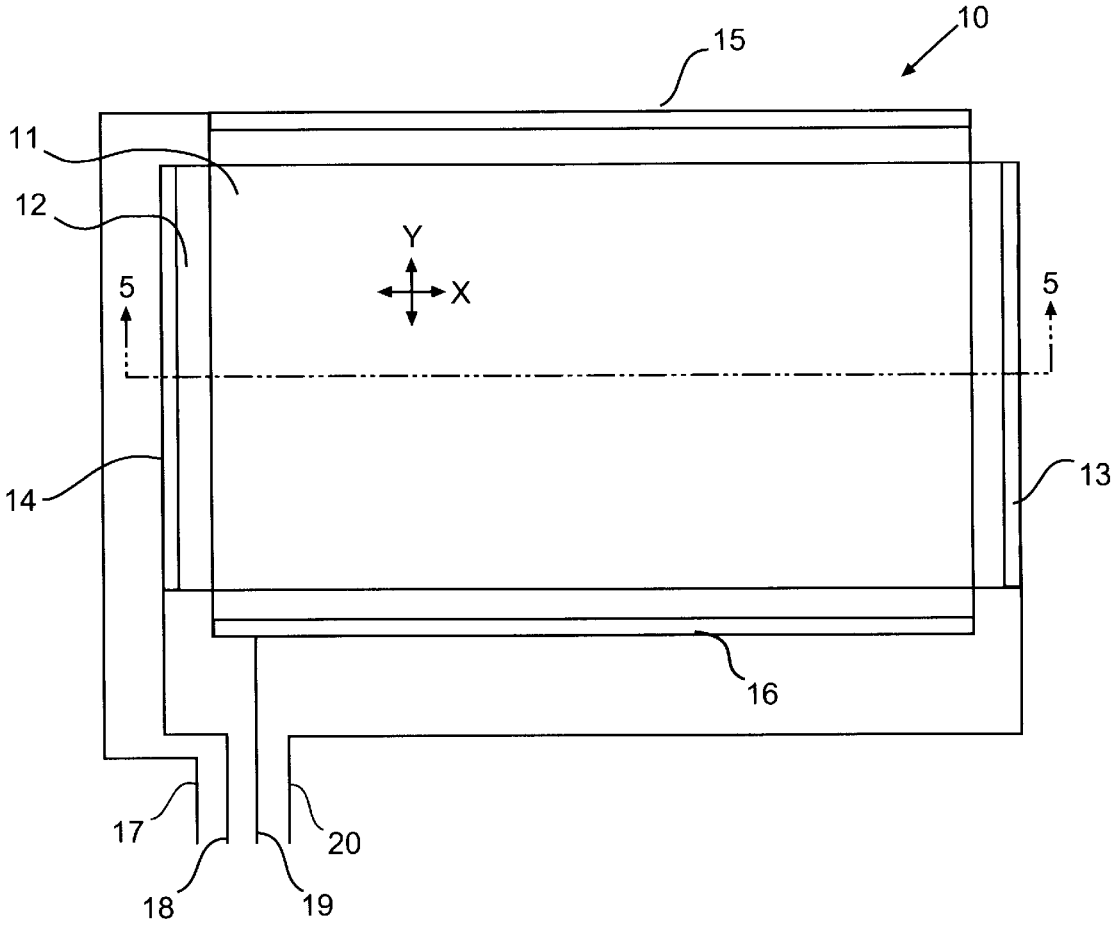
FIG. 1 is a plan view of an analog resistance touch screen switch of the present invention.
Figure 8:
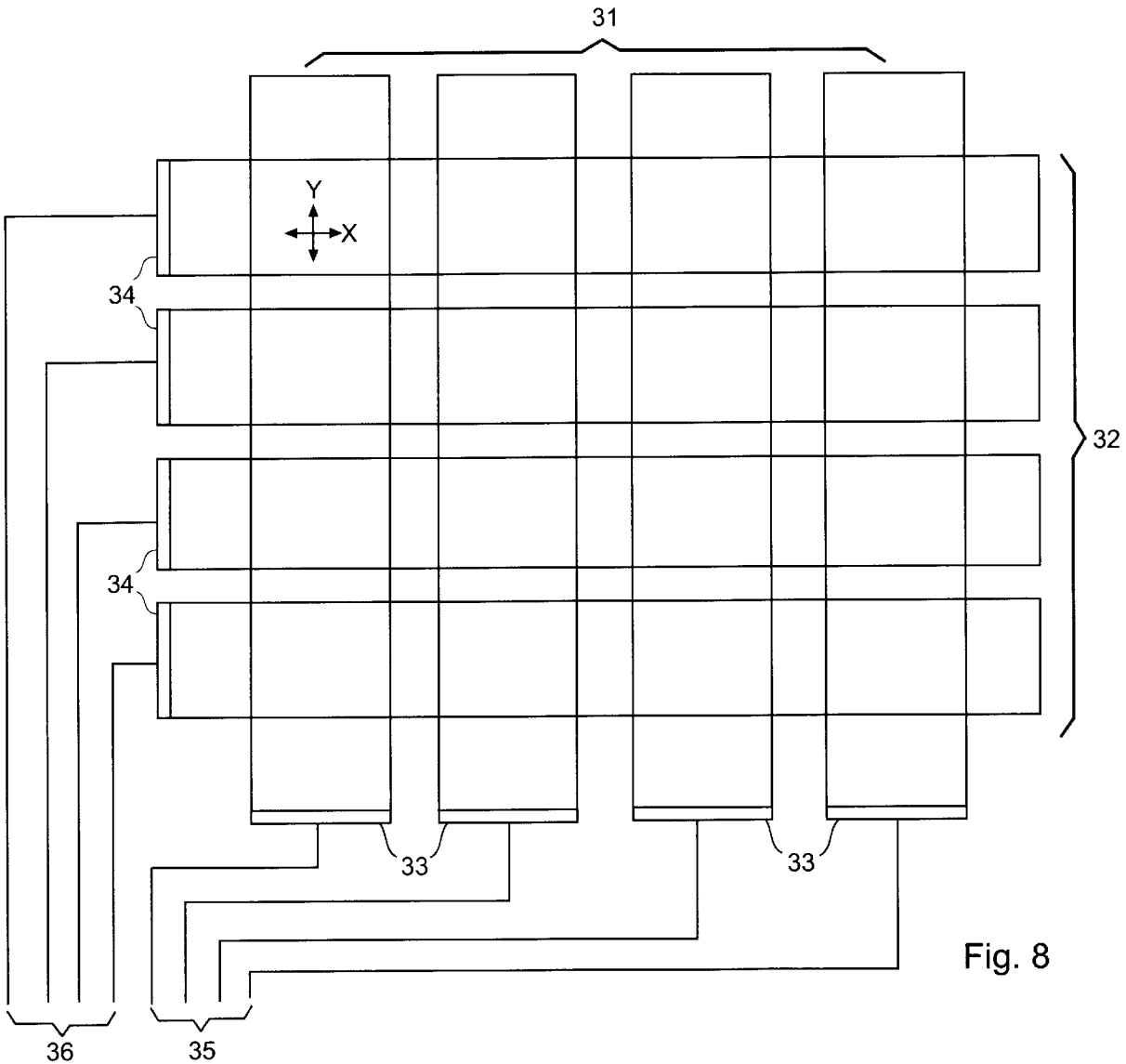
FIG. 8 is a plan view of a second embodiment of the present invention.

The preferred form of the invention is a switch within a larger switching device of the type having a construction of relatively thin or low profile membranes, substrates and films. Such larger switching devices include transparent touch panels or touch screens as illustrated in FIG. 1 and 8. The invention may be applied, however, to other types of switches.

Figure 2:
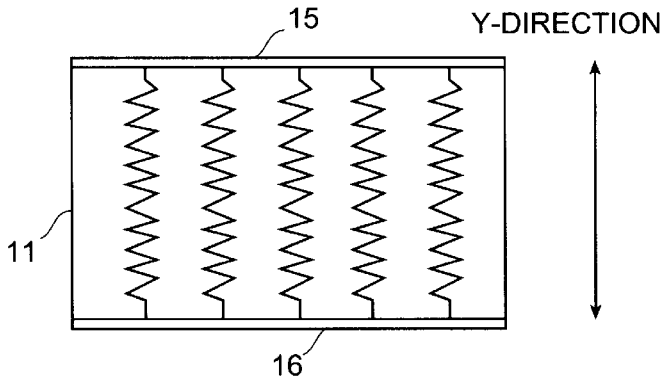
FIGS. 2 and 3 are schematic detail diagrams of the touch screen switch of FIG. 1.
Figure 3:
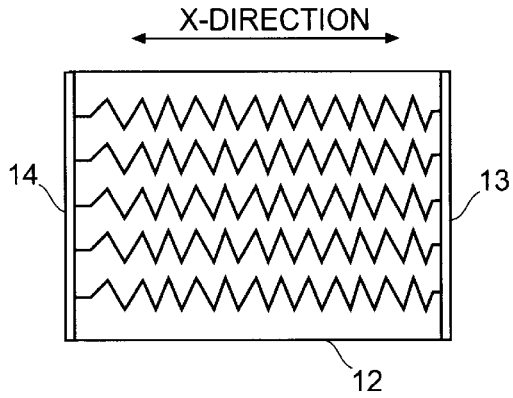

FIGS. 1–3 shows an analog resistive type of touch screen 10 which includes a top transparent layer 11 disposed over a bottom transparent layer 12. As seen in detail sketches in FIGS. 2 and 3, the top layer 11 acts as a resistive layer running in a Y-direction between upper bus bar 15 and lower bus bar 16, and the bottom layer 12 acts as a resistive layer running in an X-direction between right side bus bar 13 and left side bus bar 14. As seen in FIG. 1, right side bus bar 13 and left side bus bar 14 are connected to thick film conductors 18 and 20 of silver particle-filled polymer, which in turn connect to decoding circuitry (not shown) of a type known in the art. Similarly, upper bus bar 15 and lower bus bar 16 are connected to the decoding circuitry by thick film conductors 17 and 19 of silver particle-filled polymer.

Figure 4:
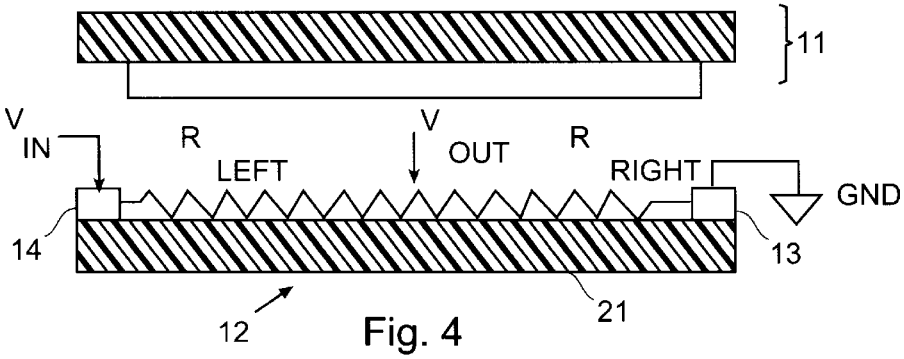
FIG. 4 is a schematic sectional view of the touch screen switch of FIG. 1.

As shown in FIG. 4, the analog resistive touch switch 10 is operated by applying a voltage gradient ($V_{IN}$) across one conductive layer (the bottom layer 12 in this instance) and measuring voltage $V_{OUT}$ at a point of contact with the opposing conductive layer 11, which is left floating to sense $V_{OUT}$. The bottom layer 12 comprises a substrate 21, bus bars 13, 14, and a transparent resistive coating (shown as two resistors $R_{LEFT}$ and $R_{RIGHT}$) connected in series between the two bus bars 13, 14. The point of contact is represented by the vertical arrow marked $V_{OUT}$. The resistance between the point of contact $V_{OUT}$ and the right bus bar 13 is represented by $R_{RIGHT}$, and the resistance between the point of contact $V_{OUT}$ and the left bus bar 14 is represented by $L_{RIGHT}$. The ratio of voltage measured between the point of contact and the grounded bus bar 13 to the voltage gradient ($V_{IN}$) is equal to the ratio of the resistance, $R_{RIGHT}$, to the total resistance $R_{RIGHT}+R_{LEFT}$. Thus, the touch switch acts as a voltage divider circuit. By alternately applying the voltage gradient (one bus bar at $V_{IN}$, the opposite bus bar grounded) in the X-direction, and later in the Y-direction, and using $V_{OUT}$ valves, the X-Y coordinates of the touch can be determined by the decoding circuitry.

As shown in FIGS. 2 and 3, the conductive layers 11 and 12 can be represented as a group of resistive elements which are connected in parallel. They further illustrate, that the total resistance in the X-direction between the bus bars 13, 14, is the same, without regard to the Y-coordinate along the bus bars 13, 14. Also, the total resistance in the Y-direction between the bus bars 15, 16 is the same, without regard to the X-coordinate along bus bars 15, 16.

Figure 5:
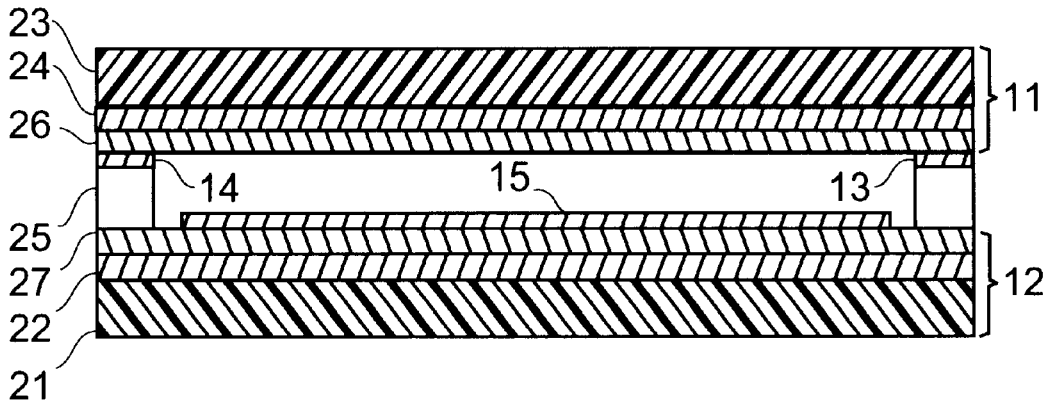
FIG. 5 is a sectional view in elevation taken in the plane indicated by line 5—5 in FIG. 1.

Referring to FIG. 5, in which the thickness is exaggerated and not to scale, the bottom layer 12 of the touch panel 10 includes a substrate 21 of polyester. The substrate 21 is flexible, but could also be rigid. Other suitable materials for the substrate 21 include glass. A thin film of indium tin oxide (ITO) is sputtered on the substrate 21 to form a rectangular-shaped conductive element 22 of from 60 to 500 ohms per square over the top surface of the substrate 21. Thus far, the bottom layer 12 is of a type known in the art. The ITO is a semiconductive ceramic with excellent transparency and light transmitting characteristics. Tin oxide can also be used for the conductive layer 22. The top layer 11 includes a flexible sheet of polyester 23. A thin film of indium tin oxide (ITO) is sputtered on one side, which becomes the underside of the top layer 11, to form a rectangular-shaped conductive element 24 opposing conductive element 22. Thus far, the top layer is of a type known in the art.

Continuing with the description relative to FIG. 5, a spacer of adhesive 25 is formed in a rectangular pattern with a central opening between the top and bottom layers 11, 12. The width of the switch is not to scale relative to the thickness in FIG. 5, so that both left and right sides of adhesive perimeter 25 can be seen in FIG. 5. Bus bars 13, 14, 15, 16 of silver particle-filled polymer thick film conductive ink, usually about 1000 times more conductive than the ITO layers, are formed along the edges of layers 11, 12 as seen in FIG. 1. Bus bars 13 and 14 contact the layer 26, which contacts layer 24, as seen in FIG. 5. Bus bars 15 and 16 contact layer 27, which contacts layer 22, as seen in FIG. 5.

Figure 6:
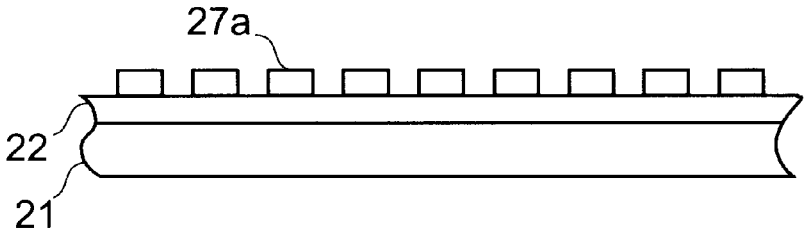
FIG. 6 is a enlarged, elevational view of a portion of FIG. 5.
Figure 7:
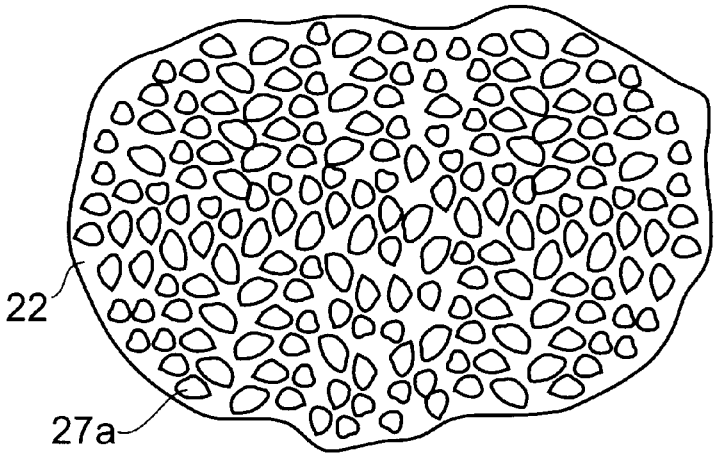
FIG. 7 is a fragmentary plan view of a portion of FIG. 6.

The invention provides an additional, very thin film of palladium 26 which is coated over the ITO layer 24. This film may be in the range from about 5 Å to about 70 Å thick. In the preferred embodiment, the film is coated at a thickness of about 10 Å to about 30 Å, these thicknesses being difficult to measure. Also, in the preferred embodiment, a second film 27 of palladium is coated on the bottom ITO layer 22. At this thickness, the metal film probably forms islands 27*a*, as shown in FIGS. 6 and 7, rather than a continuous film. Therefore, sheet resistance is still controlled by the ITO layers 22, 24. Optical absorption is very low and light transmission qualities are decreased by about 1% to 4%, which is not considered significant.

Contact resistance, which is a surface phenomenon, has been measured with the 10 Å–30 Å thickness of palladium film, as described above, on top of ITO. The contact resistance was much lower than ITO alone at the beginning of the test, increased only slightly during switch closure cycling tests and generally provided much more consistent performance than ITO without such a film.

In one test, a palladium film of 10 Å–30 Å thickness, as described above, was deposited onto touch panel material that was made of the standard high resistance (300 to 500 ohm/square) ITO film, and was assembled into a test switch. This test switch, along with a switch made from the identical film with no palladium, were actuated in an identical fashion. The actuator dropped a sine-wave driven weight of about 150 grams onto a single spot on the switch three times per second. The tip of the actuator was a 0.5-inch diameter silicone rubber hemisphere. The switches were unpowered and the contact resistance was measured at intervals up to 1,000,000 actuations and more, for the palladium switch. The non-coated switch exhibited erratic resistance values that varied as much as +/−20% even before the actuation test was begun, whereas the palladium-coated switch varied less than +/−1.5%. The initial contact resistance of the palladium-coated switch was less than half of the non-coated switch, which may be significant, although the switch geometry was not identical. After 1,000,000 actuations, the non-coated switch showed average contact resistance increases of about 100%, if spurious extremely high readings are ignored, whereas after 1,500,000 actuations, the palladium film switch resistance increased only 14%, and had no high resistance readings.

In a second test, analog resistive touch screens were tested for actuation life to compare screens made with and without a thin palladium film on both contacts as described herein. Tests were performed with a 5/8" diameter silicone hemispherical "finger" and a 0.060" diameter flat Delrin™ plastic tip. Actuations were at 3 Hz with 140 grams of force. The touch screens were powered with conventional 8-bit decoding circuitry. The position of the touch was monitored by a computer every 15 minutes, where an average of 30 points was compared to the initial position. Failure and therefore termination of the test was determined when the measured position moved 10% of full scale from the initial position. The test results are presented below. Test results for the palladium were terminated prior to failure so the data represents only a minimum of actuation life and the actual life could be much greater. All numbers are given in thousands of actuations and represent averages of a number of tests excluding the high and low readings.

| Screen Type | Silicone Tip | Plastic Tip |
|---|---|---|
| Non-Coated | 36,000 | 128,000 |
| Palladium-Coated | 835,000 | 2,066,000 |

The invention is also illustrated as applicable to a touch switch of the matrix type seen in FIG. 8. In this switch 30 a plurality of transparent conductors 31 running in the Y-direction are formed of thin film ITO material on the underside of top flex layer (not shown). A second plurality of transparent conductors 32 are formed of ITO material on the top of substrate (not shown). Bus bars 33 of silver particle-filled polymer thick film ink connect to the ends of the conductors 31. Bus bars 34 of the same material connect to conductors 32. When the flex layer with conductors 31 is flexed, contact is made at the intersection of one conductor 31 running in the Y-direction and one conductor 32 running in the X-direction. Conductive traces 35, 36 of silver particle-filled polymer thick film ink connect these conductors 31, 32 to suitable decoding circuitry of a type known in the art to determine the X-Y position of matrix touch panel activation. The ITO conductive strips 31 and 32 can be coated with a thin film of palladium 27 as shown in FIGS. 6 and 7 to accomplish the same results as discussed above for the analog resistive touch screen in inhibiting changes in contact resistance.

This description has been by way of example of how the invention can be carried out. Those of ordinary skill in the art will recognize that various details may be modified in arriving at other detailed embodiments, and that many of these embodiments will come within the scope of the invention. Therefore to apprise the public of the scope of the invention and the embodiments covered by the invention the following claims are made.

We claim:

1. An analog touch screen, comprising:

a top transparent layer disposed over a bottom transparent layer, the top layer comprising a flexible sheet having a layer of a semiconductive ceramic coated on a lower face thereof, and the bottom transparent layer comprising a substrate sheet having a thin layer of a semiconductive ceramic coated on an upper face thereof;

a non-electrically conductive spacer interposed between the top and bottom layers effective for spacing apart the layers of semiconductive ceramic except when the top layer is flexed by an external touch so that electrical contact occurs between the semiconductive layers at a location where the touch occurred;

a noncontinuous, electrically conductive metallic film which in use does not form an appreciable amount of an insulating oxide, the film covering at least one of the layers of semiconductive ceramic so that the film is interposed between the semiconductive layers during electrical contact caused by a touch, the metallic film being of a thickness effective to reduce the effects of repeated operation on contact resistance over many operating cycles of the touch screen without substantially varying the sheet resistance of the underlying semiconductive ceramic layer; and conductors connected to the transparent layers for applying an electrical current to the semiconductive layers to determine the horizontal and vertical position of the external touch on the top layer.

2. The analog touch screen of claim 1, wherein the metallic film consists essentially of a metal selected from the group consisting of palladium, platinum, iridium, gold, silver, rhodium, or a mixture thereof.

3. The analog touch screen of claim 2, wherein the metallic film consists essentially of palladium.

4. The analog touch screen of claim 3, wherein the metallic film has a thickness in the range of about 5 Å to about 70 Å inclusive.

5. The analog touch screen of claim 4, wherein the metallic film has a thickness in the range of about 10 Å to about 30 Å inclusive.

6. The analog touch screen of claim 5, wherein the layers of semiconductive ceramic consist essentially of indium tin oxide or tin oxide.

7. The analog touch screen of claim 6, wherein the metallic film is an exposed surface layer on at least one of the semiconductive ceramic layers.

8. The analog touch screen of claim 7, wherein the conductors include two pairs of conductors connected to a top and bottom edge of one of the transparent layers and to a left and right edge of the other of the transparent layers.

9. The analog touch screen of claim 6, wherein the metallic film is formed on both the layers of semiconductive ceramic and is formed as an exposed surface layer on each of the semiconductive ceramic layers so that the resulting metallic films come into contact with one another when electrical contact occurs between the semiconductive layers.

10. The analog touch screen of claim 6, wherein the substrate sheet consists essentially of polyester or glass, and the flexible sheet consists essentially of polyester.

11. The analog touch screen of claim 1, wherein the layers of semiconductive ceramic consist essentially of indium tin oxide or tin oxide.

12. The analog touch screen of claim 11, wherein the substrate sheet consists essentially of polyester or glass, and the flexible sheet consists essentially of polyester.

13. The analog touch screen of claim 1, wherein the metallic film has a thickness in the range of about 5 Å to about 70 Å inclusive.

14. The analog touch screen of claim 13, wherein the metallic film is an exposed surface layer on at least one of the semiconductive ceramic layers.

15. The analog touch screen of claim 14, wherein the metallic film has a thickness in the range of about 10 Å to about 30 Å inclusive.

16. The analog touch screen of claim 1, wherein the metallic film is formed on both the layers of semiconductive ceramic and is formed as an exposed surface layer on each of the semiconductive ceramic layers so that the resulting metallic films come into contact with one another when electrical contact occurs between the semiconductive layers.

17. The analog touch screen of claim 1, wherein the conductors include two pairs of conductors connected to a top and bottom edge of one of the transparent layers and to a left and right edge of the other of the transparent layers.

* * * * *